US006541689B1

(12) United States Patent
Fay et al.

(10) Patent No.: US 6,541,689 B1
(45) Date of Patent: Apr. 1, 2003

(54) INTER-TRACK COMMUNICATION OF MUSICAL PERFORMANCE DATA

(75) Inventors: Todor C. Fay, Bellevue; Mark T. Burton, Redmond, both of WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/243,083

(22) Filed: Feb. 2, 1999

(51) Int. Cl.[7] ..... G10H 7/00
(52) U.S. Cl. ..... 84/601; 84/609
(58) Field of Search ..... 84/601, 609, 613, 84/634, 637, 645

(56) References Cited

U.S. PATENT DOCUMENTS

| | | | | | |
|---|---|---|---|---|---|
| 4,526,078 | A | | 7/1985 | Chadabe | 84/1.03 |
| 4,716,804 | A | | 1/1988 | Chadabe | 84/1.03 |
| 5,052,267 | A | | 10/1991 | Ino | 84/613 |
| 5,164,531 | A | | 11/1992 | Imaizumi et al. | 84/634 |
| 5,179,241 | A | | 1/1993 | Okuda et al. | 84/613 |
| 5,218,153 | A | | 6/1993 | Minamitaka | 84/613 |
| 5,278,348 | A | | 1/1994 | Eitaka et al. | 84/636 |
| 5,281,754 | A | | 1/1994 | Farrett et al. | 84/609 |
| 5,286,908 | A | | 2/1994 | Jungleib | 81/603 |
| 5,315,057 | A | | 5/1994 | Land et al. | 84/601 |
| 5,355,762 | A | * | 10/1994 | Tabata | 84/609 |
| 5,455,378 | A | * | 10/1995 | Paulson et al. | 84/610 |
| 5,496,962 | A | * | 3/1996 | Meier et al. | 84/601 |
| 5,596,159 | A | * | 1/1997 | O'Connell | 84/645 X |
| 5,734,119 | A | * | 3/1998 | France et al. | 84/645 X |
| 5,753,843 | A | | 5/1998 | Fay | 84/609 |
| 5,902,947 | A | * | 5/1999 | Burton et al. | 84/609 X |

* cited by examiner

*Primary Examiner*—Jeffrey Donels
(74) *Attorney, Agent, or Firm*—Lee & Hayes, PLLC

(57) ABSTRACT

A music generation system includes a segment manager and a plurality of segment objects. Each segment object has one or more track objects. Each track object containing a time sequence of musical performance data. Some of the track objects are dependent track objects and some of the track objects are controlling track objects. The dependent track objects contain dependent musical performance data that is interpreted based on controlling musical performance data contained in one or more of the controlling track objects. Each of the controlling track objects contains a predefined type of controlling musical performance data, wherein a plurality of different control type identifiers correspond respectively to different predefined types of controlling musical performance data. When a dependent track object needs controlling musical performance data, the track object calls the segment manager with an argument comprising a control type identifier. The segment manager responds by calling one or more segment objects with arguments that include the received control type identifier. In response a called segment object identifies one of its track objects that contains the requested type of controlling musical performance data and returns the musical performance data from the identified track object to the segment manager.

28 Claims, 5 Drawing Sheets

INTER-TRACK COMMUNICATION OF MUSICAL PERFORMANCE DATA

TECHNICAL FIELD

This invention relates to systems and methods for computer generation of musical performances. Specifically, the invention relates to a software architecture that allows dependent music tracks to obtain control data from dynamically chosen controlling music tracks.

BACKGROUND OF THE INVENTION

Musical performances have become a key component of electronic and multimedia products such as stand-alone video game devices, computer-based video games, computer-based slide show presentations, computer animation, and other similar products and applications. As a result, music generating devices and music playback devices are now tightly integrated into electronic and multimedia components.

Musical accompaniment for multimedia products can be provided in the form of digitized audio streams. While this format allows recording and accurate reproduction of non-synthesized sounds, it consumes a substantial amount of memory. As a result, the variety of music that can be provided using this approach is limited. Another disadvantage of this approach is that the stored music cannot be easily varied. For example, it is generally not possible to change a particular musical part, such as a bass part, without re-recording the entire musical stream.

Because of these disadvantages, it has become quite common to generate music based on a variety of data other than pre-recorded digital streams. For example, a particular musical piece might be represented as a sequence of discrete notes and other events corresponding generally to actions that might be performed by a keyboardist—such as pressing or releasing a key, pressing or releasing a sustain pedal, activating a pitch bend wheel, changing a volume level, changing a preset, etc. An event such as a note event is represented by some type of data structure that includes information about the note such as pitch, duration, volume, and timing. Music events such as these are typically stored in a sequence that roughly corresponds to the order in which the events occur. Rendering software retrieves each music event and examines it for relevant information such as timing information and information relating the particular device or "instrument" to which the music event applies. The rendering software then sends the music event to the appropriate device at the proper time, where it is rendered. The MIDI (Musical Instrument Digital Interface) standard is an example of a music generation standard or technique of this type, which represents a musical performance as a series of events.

There are a variety of different techniques for storing and generating musical performances, in addition to the event-based technique utilized by the MIDI standard. As one example, a musical performance can be represented by the combination of a chord progression and a "style". The chord progression defines a series of chords, and the style defines a note pattern in terms of chord elements. To generate music, the note pattern is played against the chords defined by the chord progression.

A "template" is another example of a way to represent a portion of a musical performance. A template works in conjunction with other composition techniques to create a unique performance based on a musical timeline.

These different techniques correspond to different ways of representing music. When designing a computer-based music generation and playback system, it is desirable for the system to support a number of different music representation technologies and formats, such as the MIDI, style and chord progression, and template technologies mentioned above. In addition, the playback and generation system should support the synchronized playback of traditional digitized audio files, streaming audio sources, and other combinations of music-related information such as lyrics in conjunction with sequenced notes.

A concurrently filed United States Patent Application, entitled "Track Based Music Performance Architecture" by inventors Todor C. Fay and Mark T. Burton, describes an architecture that easily accommodates various different types of music generation techniques. In the system described in that application, a piece of music is embodied as a programming object, referred to as a segment or segment object. The segment object has an interface that can be called by a playback program to play identified intervals of the music piece. Each segment comprises a plurality of tracks, embodied as track objects. The track objects are of various types for generating music in a variety of different ways, based on a variety of different data formats. Each track, regardless of its type, supports an identical interface, referred to as a track interface, that is available to the segment object. When the segment object is instructed to play a music interval, it passes the instruction on to its constituent tracks, which perform the actual music generation. In many cases, the tracks cooperate with each other to produce music. The cited application describes inter-track object interfaces that facilitate communication between the tracks, thereby allowing one track to obtain data from another track. This is used, for example, by a style track in order to obtain chord information from a chord progression track—the style track needs the chord information for proper interpretation of notes within the style track, which are defined in terms of chord elements.

The application cited above assumes that inter-track communications take place primarily between track objects of a single segment, although the disclosed inter-track object interfaces can of course also be called from track objects of other segments. However, no mechanism is provided for a track of one segment to obtain a reference to track interface of a track in a different segment. Obtaining such a reference can be problematic, especially when the system allows segments to be initiated and terminated dynamically during a music performance. In this case, a given track should not be designed to rely on a particular track in another segment, because that segment may not even exist when the performance is actually rendered.

The invention described below relates to a more flexible way for music track objects to utilize control data from other music track objects—especially from music track objects of different music segment objects. Using the invention, multiple segment objects can be active at any given time and can change during a musical performance. Individual tracks are designed without specifying the exact source of their control information. Rather, the system determines an appropriate track to provide such control information during the performance itself. This provides a tremendous amount of flexibility in designing a performance.

SUMMARY OF THE INVENTION

In accordance with one aspect of the invention, a segment manager is used to coordinate a performance and to facilitate inter-track communications. Tracks are implemented as objects. A given track object can be a dependent track object, a control track object, or both. A dependent track object is one whose data is interpreted against control data from another track object. A control track object is one that supplies control data for use by another track object.

At any given time, a performance can include any number of active segments. The active segments have relative priorities, determined either dynamically or at the time the performance is authored. When a dependent segment needs control data of a particular type, it requests such control data from the segment manager. The segment manager notes the type of data requested, and in response queries the segments, in order of priority, to find a track containing control data of the requested type. When such a track is found, its control data is returned to the requesting track.

DETAILED DESCRIPTION

Computing Environment

Figure 1:
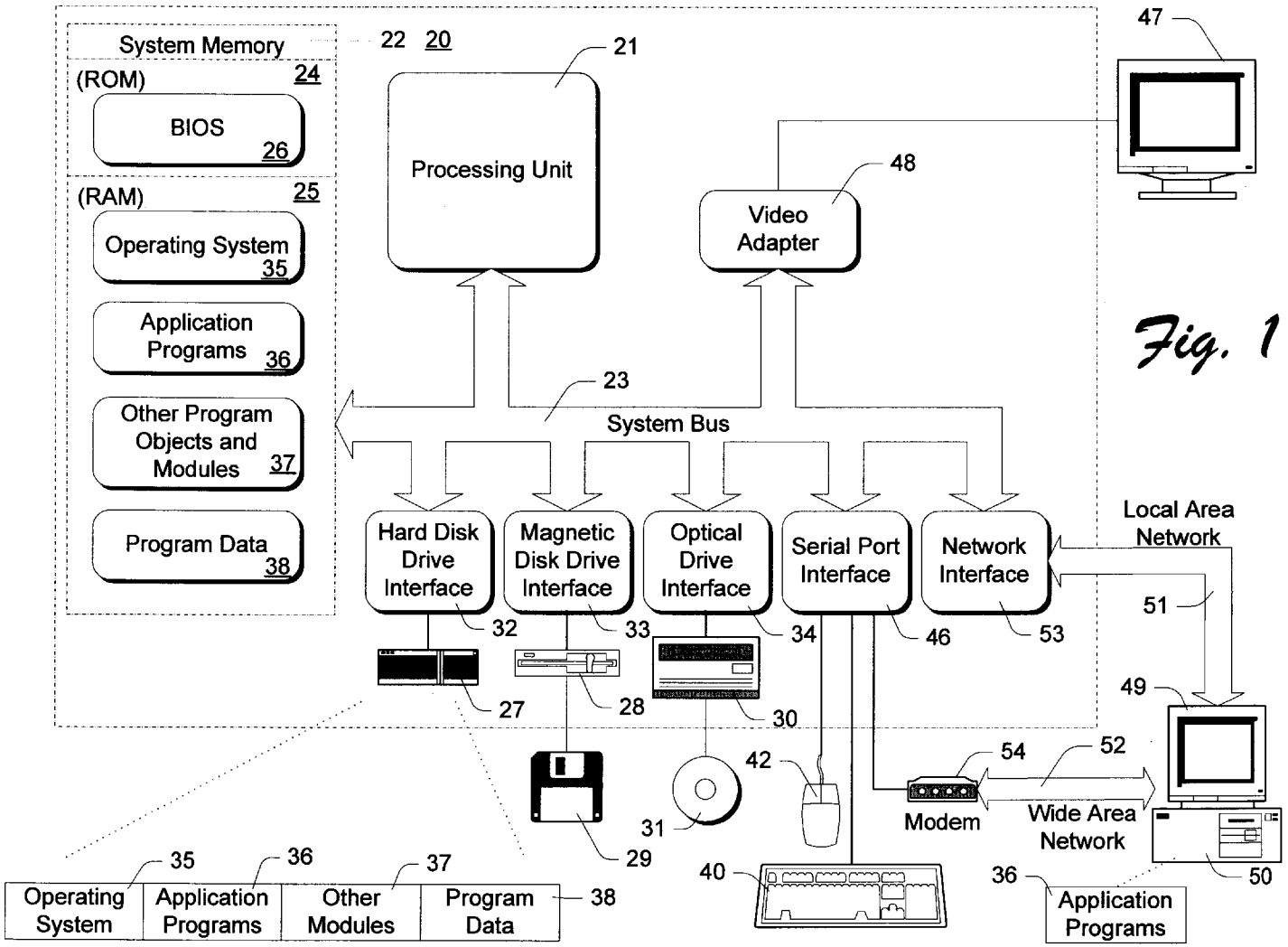
FIG. 1 is a block diagram of a computer system that implements the invention.

FIG. 1 and the related discussion are intended to provide a brief, general description of a suitable computing environment in which the invention may be implemented. Although not required, the invention will be described in the general context of computer-executable instructions, such as programs and program modules that are executed by a personal computer. Generally, program modules include routines, programs, objects, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, network PCs, minicomputers, mainframe computers, and the like. The invention may also be practiced in distributed computer environments where tasks are performed by remote processing devices that are linked through a communications network. In a distributed computer environment, program modules may be located in both local and remote memory storage devices.

An exemplary system for implementing the invention includes a general purpose computing device in the form of a conventional personal computer 20, including a microprocessor or other processing unit 21, a system memory 22, and a system bus 23 that couples various system components including the system memory to the processing unit 21. The system bus 23 may be any of several types of bus structures including a memory bus or memory controller, a peripheral bus, and a local bus using any of a variety of bus architectures. The system memory includes read only memory (ROM) 24 and random access memory (RAM) 25. A basic input/output system 26 (BIOS), containing the basic routines that help to transfer information between elements within personal computer 20, such as during start-up, is stored in ROM 24. The personal computer 20 further includes a hard disk drive 27 for reading from and writing to a hard disk, not shown, a magnetic disk drive 28 for reading from or writing to a removable magnetic disk 29, and an optical disk drive 30 for reading from or writing to a removable optical disk 31 such as a CD ROM or other optical media. The hard disk drive 27, magnetic disk drive 28, and optical disk drive 30 are connected to the system bus 23 by a hard disk drive interface 32, a magnetic disk drive interface 33, and an optical drive interface 34, respectively. The drives and their associated computer readable media provide nonvolatile storage of computer readable instructions, data structures, program modules and other data for the personal computer 20. Although the exemplary environment described herein employs a hard disk, a removable magnetic disk 29 and a removable optical disk 31, it should be appreciated by those skilled in the art that other types of computer readable media which can store data that is accessible by a computer, such as magnetic cassettes, flash memory cards, digital video disks, Bernoulli cartridges, random access memories (RAMs) read only memories (ROM), and the like, may also be used in the exemplary operating environment.

RAM 25 forms executable memory, which is defined herein as physical, directly-addressable memory that a microprocessor accesses at sequential addresses to retrieve and execute instructions. This memory can also be used for storing data as programs execute.

A number of programs and/or program modules may be stored on the hard disk, magnetic disk 29 optical disk 31, ROM 24, or RAM 25, including an operating system 35, one or more application programs 36, other program objects and modules 37, and program data 38. A user may enter commands and information into the personal computer 20 through input devices such as keyboard 40 and pointing device 42. Other input devices (not shown) may include a microphone, joystick, game pad, satellite dish, scanner, or the like. These and other input devices are often connected to the processing unit 21 through a serial port interface 46 that is coupled to the system bus, but may be connected by other interfaces, such as a parallel port, game port, or a universal serial bus (USB). A monitor 47 or other type of display device is also connected to the system bus 23 via an interface, such as a video adapter 48. In addition to the monitor, personal computers typically include other peripheral output devices (not shown) such as speakers and printers.

The personal computer 20 may operate in a networked environment using logical connections to one or more remote computers, such as a remote computer 49. The remote computer 49 may be another personal computer, a server, a router, a network PC, a peer device or other common network node, and typically includes many or all of the elements described above relative to the personal computer 20, although only a memory storage device 50 has been illustrated in FIG. 1. The logical connections depicted in FIG. 1 include a local area network (LAN) 51 and a wide area network (WAN) 52. Such networking environments are commonplace in offices, enterprise-wide computer networks, intranets, and the Internet.

When used in a LAN networking environment, the personal computer 20 is connected to the local network 51 through a network interface or adapter 53. When used in a WAN networking environment, the personal computer 20 typically includes a modem 54 or other means for establishing communications over the wide area network 52, such as the Internet. The modem 54, which may be internal or external, is connected to the system bus 23 via the serial port interface 46. In a networked environment, program modules depicted relative to the personal computer 20, or portions thereof, may be stored in the remote memory storage device. It will be appreciated that the network connections shown are exemplary and other means of establishing a communications link between the computers may be used.

Generally, the data processors of computer 20 are programmed by means of instructions stored at different times in the various computer-readable storage media of the computer. Programs and operating systems are typically distributed, for example, on floppy disks or CD-ROMs. From there, they are installed or loaded into the secondary memory of a computer. At execution, they are loaded at least partially into the computer's primary electronic memory. The invention described herein includes these and other various types of computer-readable storage media when such media contain instructions or programs for implementing the steps described below in conjunction with a microprocessor or other data processor. The invention also includes the computer itself when programmed according to the methods and techniques described below. Furthermore, certain sub-components of the computer may be programmed to perform the functions and steps described below. The invention includes such sub-components when they are programmed as described.

For purposes of illustration, programs and other executable program components such as the operating system are illustrated herein as discrete blocks, although it is recognized that such programs and components reside at various times in different storage components of the computer, and are executed by the data processor(s) of the computer.

The illustrated computer uses an operating system such as thc "Windows" family of operating systems available from Microsoft Corporation. An operating system of this type can be configured to run on computers having various different hardware configurations, by providing appropriate software drivers for different hardware components. The functionality described below is implemented using standard programming techniques, including the use of OLE (object linking and embedding) and COM (component object interface) interfaces such as described in Rogerson, Dale; *Inside COM;* Microsoft Press, 1997. Familiarity with object based programming, and with COM objects in particular, is assumed throughout this disclosure.

General Object Architecture

Figure 2:
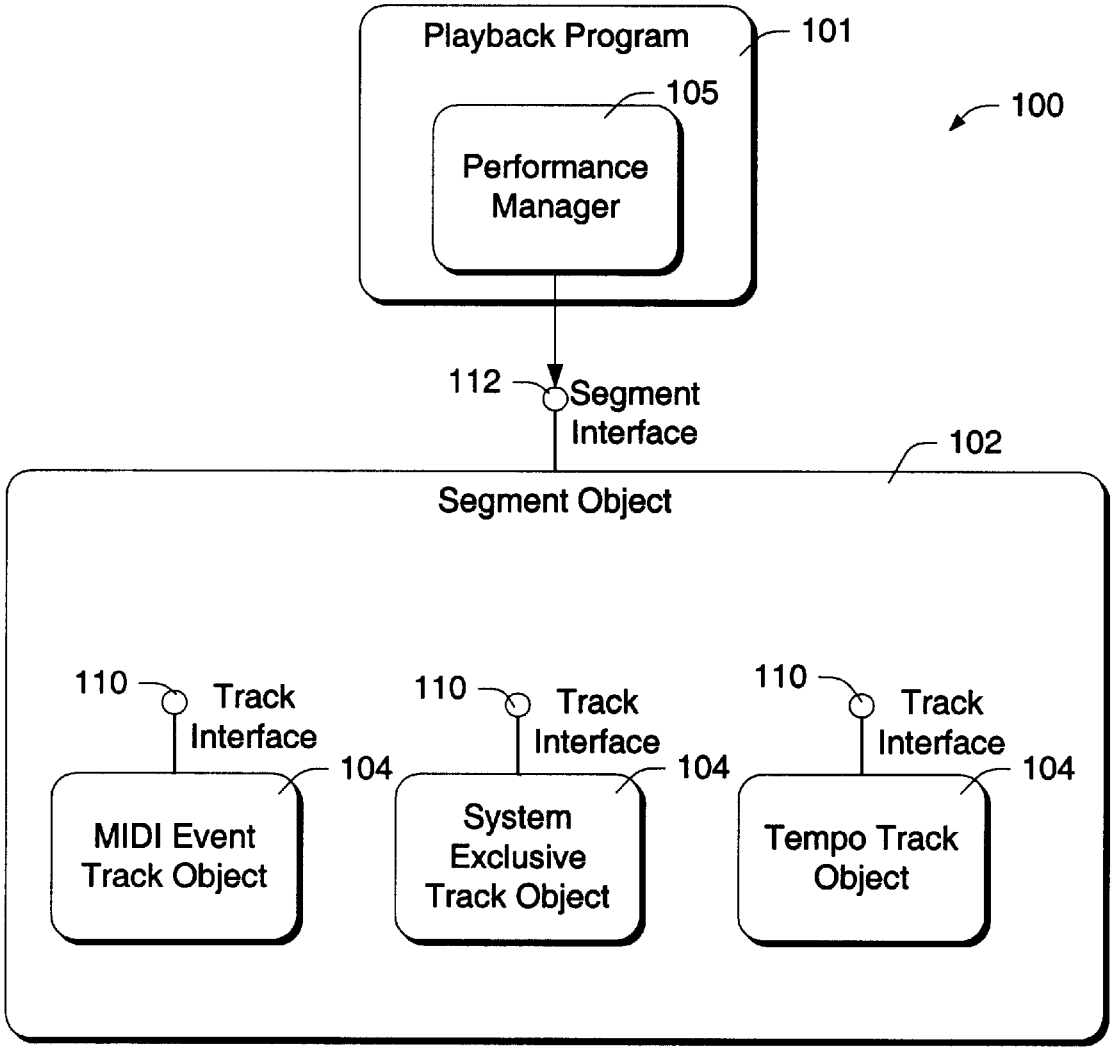
FIG. 2 is a block diagram of software components for rendering MIDI-based music.

FIG. 2 shows a music generation or playback system 100 in accordance with the invention. In the described embodiment of the invention, various components are implemented as COM objects in system memory 22 of computer 20. The COM objects each have one or more interfaces, and each interface has one or more methods. The interfaces and interface methods can be called by application programs and by other objects. The interface methods of the objects are executed by processing unit 21 of computer 20. For purposes of the following discussion, the terms "interface" and "interface methods" are used in a general sense to reference programmatic mechanisms for obtaining the services of objects or other program components, rather than to the specific interface mechanism of the COM standard. In the embodiment described, however, the described interfaces are implemented primarily as methods of traditional COM interfaces.

Music generation system 100 includes a playback program 101 for playing musical pieces that are defined by segment objects 102 and track objects 104. The playback program utilizes a performance manager or segment manager 105 (implemented as a COM object) that makes the actual calls to a segment object, to control playback of musical pieces.

A segment object 102 is an instantiation of a COM object class, and represents a musical piece or segment such as a song or some other linear interval of music. In accordance with the invention, a particular musical performance can comprises a plurality of segments. Segments can be played one after another or concurrently with each other. Playback program 101 or segment manager 105 can specify segments dynamically, to become active at any point in a performance.

Each segment is made up of one or more tracks, which are represented as track objects 104. The tracks represented by the track objects are played together to render the musical piece represented by the segment object. Each track object contains a time sequence of musical performance data such as MIDI data or other data. Such data is interpreted, during a performance, to generate instructions for actual music generation components such as computer-integrated MIDI components and other computer based music rendering components. For example, MIDI rendering components are instructed by sending MIDI event structures, system exclusive messages, and tempo instructions. In one embodiment of the invention, the various track objects are configured to generate such MIDI instructions, though such instructions might result from non-MIDI music generation techniques.

There can be many different types of tracks and corresponding track objects, corresponding to different music generation techniques. A set of track objects might correspond to a particular music generation technique, such as MIDI sequencing, and might therefore include track objects such as an event track object, a system exclusive track object, and a tempo map track object. Another set of track objects might correspond to a style-based chord progression music generation technique. Such a set includes a chord progression track object and a style track object or style-based performance track object. The style track object plays against a chord progression defined by the chord progression track. Track objects can communicate with each other using the techniques described in the following section.

FIG. 2 shows an example of a segment having a structure that is conveniently used for representing MIDI files. This segment includes three track objects 104. An event track object can be used to render or generate standard MIDI event messages, such as notes, pitch bends, and continuous controllers. A system exclusive track object can be used to generate MIDI system exclusive messages. A tempo map track object can be used to generate changes in tempo, packaged as events. When this structure is used in conjunction with MIDI data, each track reads a corresponding MIDI data stream, parses the data stream, and sends resulting instructions to a MIDI-based rendering component. These track objects do not normally participate in shaping the generated music—the music is defined entirely by the original MIDI data stream.

Figure 3:
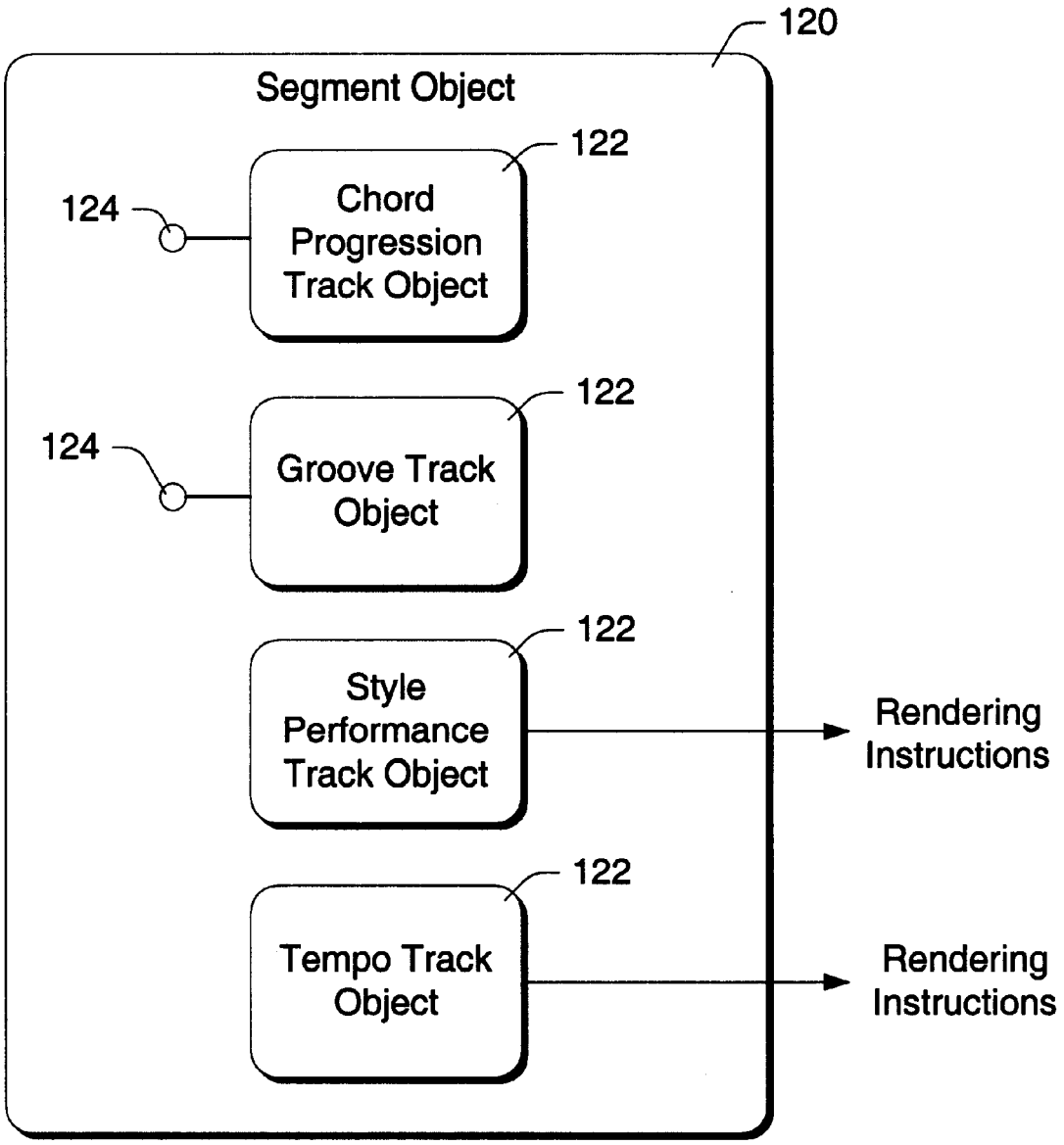
FIG. 3 is a block diagram of software components for rendering style-based music.

FIG. 3 shows a more complex example of a segment that allows adaptive creation of music. It includes a segment object 120 and a set of track objects 122 that cooperate to generate style-based and chord-based music. The track objects represent a chord progression track, a groove track, a style performance track, and a tempo map track. The chord progression track defines a sequence of chords. The groove track defines an intensity for the musical piece, which can vary as the piece progresses. The groove track also defines embellishments such as intros, breaks, endings, etc. The style performance track defines a note pattern in terms of the structures defined by the chord progression and groove tracks. The tempo track determines the tempo of the musical piece, which can vary as the piece progresses.

In the example of FIG. 3, only the style performance track object and the tempo map track object generate actual instructions for downstream music rendering components such as a MIDI-based music generation component. The chord progression track object and the groove track object are used as sources of control data for the style performance track object. They have interfaces 124 that are called by the performance track and tempo map objects to obtain such control data.

Various other types of track objects are possible, utilizing widely varying forms of music generation. For example, track objects might utilize synchronized streaming audio wave files or combinations of pre-recorded audio files. Other track objects might render music with synchronized textual lyrics (such as in a karaoke device). Track objects might also use algorithmic techniques to generate music.

All of the track objects, regardless of the track object classes from which they were instantiated, support an identical object interface referred to as a track interface 110 (FIG. 2). Track interface 110 includes a track play method that is callable to play a time-delineated portion of a track.

Although track objects are instantiated from different object classes, all segment objects are instantiated from the same object class. The segment object class is defined to expose a segment interface 112. Segment interface 112 includes a number of methods, including a segment play method that is callable to play a time-delineated portion of the overall musical piece represented by the segment object.

To play a particular musical piece, segment manager 105 calls segment object 102 and specifies a time interval or duration within the musical piece represented by the segment. The segment object in turn calls the track play methods of each of its track objects, specifying a time interval corresponding to the interval or duration specified to the segment object. The track objects respond by rendering their music at the specified times.

This architecture provides a great degree of flexibility. A particular musical piece is implemented as a segment object and a plurality of associated track objects. Playback program 101 and its performance manager 105 play the musical piece by making repeated calls to segment interface 112 to play sequential portions of the musical piece. The segment object, in turn, makes corresponding calls to the individual track interfaces 110. The track objects perform the actual music generation, independently of the playback program, of the performance object, and of the segment object.

Because of this architecture, the independence of the track objects, and the support for identical predefined track interfaces, the playback program itself is not involved in the details of music generation. Thus, a single playback program can support numerous playback technologies, including technologies that are conceived and implemented after completion of the playback program.

Inter-Track Communications

In accordance with the invention, a performance can include a plurality of different active segments. Different segments are potentially initiated and terminated at different times during the performance. Segments can overlap with each other in time, so that more than one segment is active at any given time.

Figure 4:
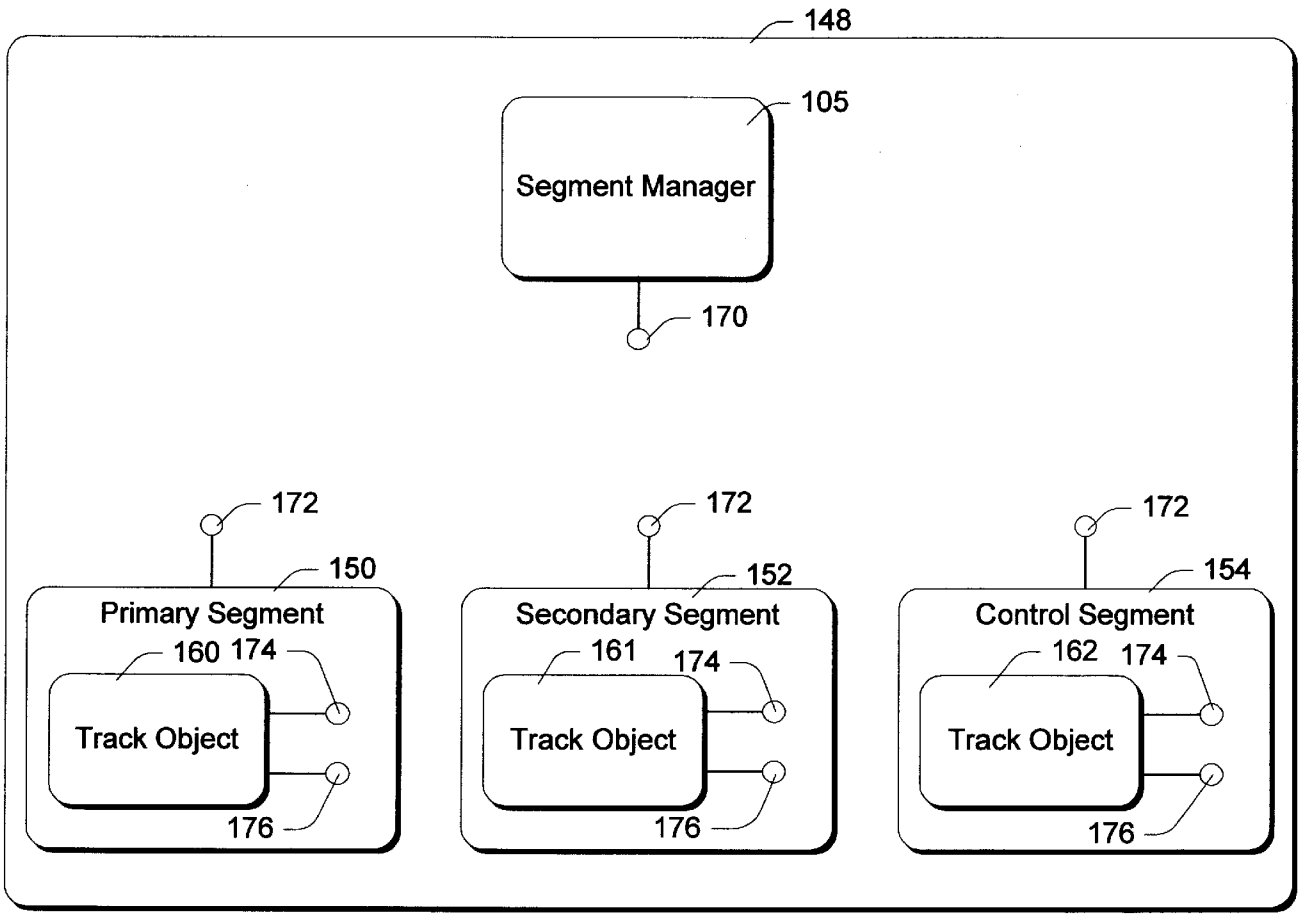
FIG. 4 is a block diagram illustrating interfaces used for inter-track communications.

FIG. 4 shows an example of a performance 148 that includes segment manager 105 and a plurality of segments or segment objects. Specifically, the performance includes shows track objects 160, 161, 162 within respective segment objects 150, 152, and 154. This architecture is in accordance with FIGS. 2 and 3, described above. Although only one track object is shown within each segment object for simplicity, it should be recognized that each segment object normally includes a plurality of track objects.

Each of the objects shown in FIG. 4 exposes a plurality of interfaces that allow control and playback of segments and tracks. FIG. 4 shows only the interfaces related to communicating control information between various tracks.

For purposes of this description, track objects are categorized as independent track objects, dependent track objects, and controlling track objects. An independent track object contains independent data such as MIDI events that can be interpreted and rendered without reference to any other tracks. A dependent track object contains data that is interpreted against control data obtained from another track. A controlling track object contains control data that is used for interpretation of another track. Thus, dependent track objects contain dependent musical performance data that is interpreted based on controlling musical performance data contained in one or more controlling track objects.

A "style" or "pattern" track is an example of a dependent track. The individual notes of a style track are defined in terms of chord elements, and therefore have meaning only in light of an underlying chord progression track. The chord progression track has control data in the form of chords that are used to interpret different tracks. Accordingly, a chord progression track object is an example of a controlling track object. It might be possible for a particular track object to be both dependent and controlling.

In many cases, the track objects of a particular segment are designed to work together, so that a dependent track object obtains controlling data from a predetermined controlling track object within the same segment. In this case, dedicated inter-track interfaces such as shown in FIG. 3 can be used to communicate the controlling data from the controlling track object to the dependent track object. In accordance with the invention, however, it is possible to obtain control data from tracks of other active segments, with the identities of those segments being determined during the performance itself by the segment manager.

In the example of FIG. 4, a segment 150 is referred to as a primary segment. There is one and only one primary segment active in a performance at any given time. A primary segment normally contains controlling track objects, and usually also contains one or more dependent track objects such as style patterns. In the example of FIG. 4, the single primary segment 150 is active during the entire performance. However, it is possible for a particular primary segment to be terminated and to be followed by a different primary segment within a given a performance.

A segment 152 is referred to as a secondary segment. Although only one secondary segment is shown in this example, a performance can include any number of concurrently active secondary segments, which can be initiated and terminated at different times within the performance. In some cases, the different secondary segments are independent or self-contained. In other cases, however, tracks of secondary segments utilize control data from the tracks of other segments such as the primary segment. A secondary segment often contains only dependent track objects, thereby requiring control data from a different segment such as the primary segment.

Another segment 154 is referred to as a control segment. A control segment generally has only control track objects, containing controlling data used for interpreting tracks of other segments. More than one control segment can be active at any given time. Control segments can be initiated and terminated at different times throughout a performance.

The designations of various segments as being primary, secondary, or control segments is made either prior to or during the performance, by playback program 101 or segment manager 105. These designations can be changed by the playback program or segment manager during the performance.

As already mentioned, a dependent track object utilizes control data from one or more other track objects. In accordance with the invention, such control data is obtained by calling a control data interface 170 of segment manager 105, rather than calling other track objects directly. The dependent track calls control data interface 170 repeatedly to obtain needed control data as the performance proceeds, specifying a time value indicating the timing of the desired control data relative to the performance.

In addition to a time value, control data interface 170 accepts a numeric or alphanumeric control type identifier that corresponds to the type of control data being sought by the calling track object. In the described embodiment, the control type identifier comprises a GUID—a "globally unique identifier." A GUID is a computer-generated value that is guaranteed to be unique. In this case, it is guaranteed to be unique for each of a plurality of different predefined types of controlling musical performance data. For example, chord progression data corresponds to one GUID, while groove level data corresponds to another GUID.

In response to being called from a track object, the segment manager queries its active segments to determine whether any of them contain control tracks that in turn contain the requested type of data. If so, such data is returned to the calling track object. The data is returned in a predefined data structure, depending on the supplied GUID. In addition, the segment manager returns the amount of time for which the returned data will be valid—the time within the controlling track until new control data occurs. Returning this time value allows the calling track to postpone any subsequent calls to the control data interface for the indicated time, since it is known that no control data changes will occur during this time.

In implementation, the segment objects are assigned relative priorities, which are used to establish an order for querying the segments to find tracks with the appropriate control data. Any active control segments have the highest priority. The single primary segment has the next-highest priority. Any active secondary segments have the lowest priorities. In the described embodiment, in fact, the secondary segments are never queried for control data. Rather, it is assumed that secondary segments obtain control data only from other, higher-priority segments.

In many cases, more than one track object within a single segment will contain control data of the requested type. For this reason, an additional mechanism is provided for distinguishing between track objects. In accordance with the invention, track objects of the same type are assigned to different groups for further identification and differentiation. Any given track object can belong to one or more track groups. The group assignments are used when requesting control data from the segment manager. Specifically, one or more groups are specified when calling the control data interface of the segment manager. In response, the segment manager identifies and returns control data only from a track object that belongs to one of the specified groups. Typically, a track object of one group seeks control data only from a track object of the same group.

As a further way to distinguish between track objects, an optional index value is specified whenever calling the control data interface. The control data interface returns control data only from a track object that has been designated to have the same index value. This allows each group to contain more than one track object of the same type or class.

In the described embodiment, a particular group assignment is specified as a bit array having 32 bit positions. Each bit position corresponds to a particular group. Setting a bit specifies the corresponding group. This scheme allows specification of more than one group, by setting more than one bit within the bit array.

The index assignment is represented by an integer.

Control Data Interface

Control data interface 170 is called by dependent track objects to obtain control information from appropriate types of tracks. The control data interface accepts the following arguments:

Control Type Identifier. A GUID in the described embodiment, this parameter identifies the type of control data being requested. Each GUID corresponds to a predefined type of control data, and a predefined data structure in which the control data is returned.

Group Specification. A bit array as described above, specifying one or more track groups. Only those track objects that belong to one of the specified groups will be used to supply the requested control data. Normally, this parameter will specify the groups of which the requesting track is a member.

Index Value. An integer specifying an index value, as described above. Only those track objects that have been assigned the indicated index value will be used to supply the requested control data.

Music Time. A time value within a performance for which control data is sought. For example, this parameter might indicate that the requesting track is seeking control data for a point 5 seconds into the performance.

Duration. This is a returned value, indicating the length of time (measured from Music Time, above) during which the returned control data will be valid. This is the length of time until the next data in the track supplying the control data Data Pointer. This points to memory that has been allocated to contain the returned control data. The amount of memory depends on the type of data being sought, as determined by the control type identifier. Each control type identifier corresponds to a particular type of data, and a particular type of data structure. Each type of data structure requires a known amount of memory. The control data interface fills this memory with the requested data structure.

Segment Data Interface

In response to being called with the arguments specified above, the control data interface of the segment manager passes the data requests to the individual segments, in order of their priority. If any control segments are active, they are queried first for the requested type of data. Otherwise, the primary segment is queried.

The query is made through a segment data interface 172 that is supported by each segment object. The segment data interface accepts arguments identical to those of the control data interface, except as noted:

Control Type Identifier.

Group Specification.

Index Value.

Segment Time. In this case, the returned time is specified relative to the start of the segment. The conversion is done by the segment manager before calling the segment data interface.

Duration. A returned value, measured from Segment Time, above.

Data Pointer.

Track TypeSupported Interface and Track Data Interface

Upon a call to its segment data interface 172, a segment object queries its individual track objects to determine whether they contain data of the requested type. For this purpose, each track object supports a TypeSupported interface 174 that is called by the track's segment object to determine whether the track object contains the type of controlling musical performance data indicated by a particular control type identifier. This interface accepts a single argument comprising a control type identifier or GUID. The track responds by returning a true or false value, indicating whether the track object contains control data of the type corresponding to the control type identifier.

Once it has been determined that a track object contains the specified type of data, the segment data object calls a track data interface 176 of the track object to obtain the actual control data. The track data interface accepts the following arguments, which are similar to the arguments described above:

Control Type Identifier. As described above.

Track Time. Specified relative to the start of the track, which is the same as the start of the segment.

Duration. A returned value, measured from Track Time, above, indicating how long any returned data will be valid.

Data Pointer. A pointer to the reserved memory into which the control data is to be written.

Operation

Figure 5:
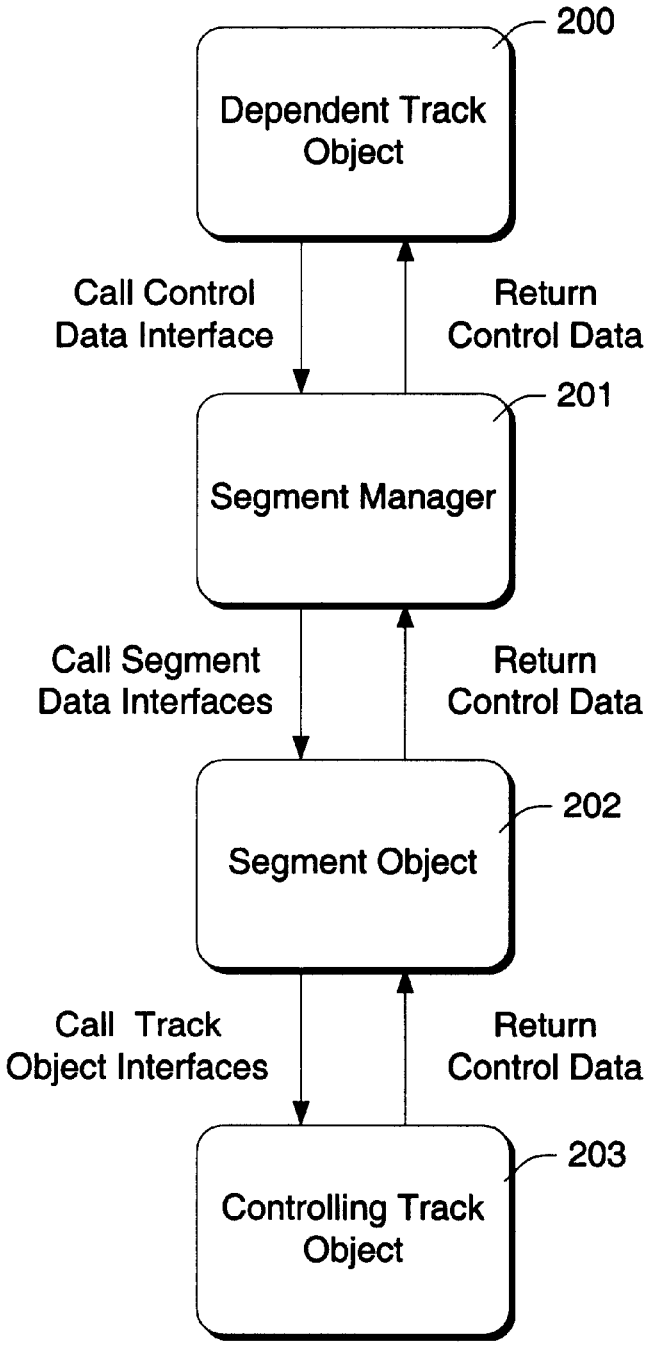
FIG. 5 is a block diagram illustrating interface calls and data flow.

FIG. 5 illustrates operation of the various components described above, showing steps relating to the process of obtaining controlling data as initiated by a single dependent track object 200. FIG. 5 assumes that a plurality of music segments or segment objects have been defined and identified, and that each such segment object contains a plurality of music tracks or track objects. Each track is defined by a time sequence of musical performance data. Some of the music tracks are dependent music tracks, and some of the tracks are controlling music tracks. The dependent music tracks contain dependent musical performance data that is interpreted based on controlling musical performance data contained in one or more of the controlling music tracks. Each of the controlling music tracks contains a predefined type of controlling musical performance data. A plurality of different control type identifiers (GUIDs) correspond respectively to the different predefined types of controlling musical performance data.

The process begins when a dependent music track object 200, such as a track object of a secondary segment object, performs a step of calling the control data interface of segment manager 201 with an argument comprising one of the control type identifiers. Additionally, the dependent music track specifies the arguments described above, including group and index specifications and a time value indicating the time within the performance for which the control data is sought.

Segment manager 201 responds by calling the segment data interfaces of one or more music segment objects 202 with the same arguments that were submitted to the segment manager, including the control type identifier. The purpose of this step is to (a) identify a music track within the called segment that contains the predefined type of controlling musical performance data corresponding to the specified control type identifier; (b) obtain controlling musical performance data from the identified music track; and (c) return the obtained controlling musical performance data to the calling music track. More specifically, this step comprises calling the segment data interfaces of the currently active segments in order of decreasing priority until identifying a music track within one of the segments that contains the predefined type of controlling musical performance data. Once valid performance data has been returned to the segment manager 201, the segment manager returns the data to the calling track object 200. The control data is returned to the calling music track in a data structure that is predefined to correspond with the submitted control type identifier. In addition to the performance data, the segment object returns a value indicating how long the returned musical performance data will be valid.

FIG. 5 shows that, in response to being called by the segment manager, a music segment object 202 performs a step of calling the track data interface of one or more of the segment object's track objects 203 with the arguments described above, including the control type identifier and the time for which the data is sought, both of which have been received as arguments of the segment data interface call. In implementation, the segment object first calls the TypeSupported interface of each of the segment's tracks that (a) belong to the group specified by the segment manager and (b) have the same index value specified by the segment manager. When the TypeSupported interface indicates that one of the qualifying track objects contains the designated type of control data, the segment object calls that track's data interface to obtain the musical performance data and a value indicating how long the data will be valid.

Conclusion

The system described above results in a number of advantages over the prior art. One advantage is that dependent tracks can be written without being tied to specific control tracks. Rather, the segment manager determines the appropriate control track during the performance, based on the currently active segments and their priorities. Dependent tracks submit requests to the segment manager, without any knowledge of the eventual track source of the controlling data.

Although control data in many situations will come primarily from the primary segment, the optional use of control segments allows the primary segment to be temporarily overridden. This feature can be used for a variety of purposes, such as temporarily altering the mood of a musical piece.

The communication mechanisms greatly reduce the required inter-track communications bandwidth by allowing requesting tracks to specify the times for which data is sought and by returning a value indicating how long the data will be valid. Rather than having to re-query at short intervals to determine whether control data has changed, the requesting track can simply wait for the indicated time, and then re-query shortly before that time to get new data. Using this scheme, only one inter-track call per data change is necessary.

When active segments change, the segment manager automatically supplies controlling data from the new segment, without adding any complications to the design of requesting tracks. For example, one primary segment might end and be followed by another primary segment. Requesting tracks of secondary segments do not need to be aware of this change, since the segment manager automatically supplies data from whatever segment is active and has the highest priority.

The concept of track groups allows segments and tracks with different controlling information which is automatically routed to corresponding dependent tracks. This allows the use of multiple control tracks without any significant increase in the complexity of designing a performance.

The system is easily extended to make use of different types of control data, by simply assigning a new control type identifier (GUID) to any new control data type. Because of the way the system is implemented, only the tracks themselves depend on the actual format of the control data. Therefore, the system can be extended without any changes to the architecture of the segments or to the segment manager.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. One or more computer-readable media containing a computer program that is defined at least in part by program objects, the objects comprising:

a plurality of segment objects;

the segment objects including track objects, each track object containing a time sequence of musical performance data, wherein some of the track objects are dependent track objects and some of the track objects are controlling track objects, and wherein the dependent track objects contain dependent musical performance data that is interpreted based on controlling musical performance data contained in one or more of the controlling track objects;

wherein each of the controlling track objects contains a predefined type of controlling musical performance data, and wherein a plurality of different control type identifiers correspond respectively to different predefined types of controlling musical performance data;

wherein each segment object supports a segment data interface that accepts an argument comprising one of the control type identifiers;

wherein in response to being called with a particular one of the control type identifiers, the segment data interface of a particular segment object identifies a track object of said particular segment object that contains the type of controlling musical performance data indicated by said particular control type identifier and returns musical performance data from the identified track object.

2. One or more computer-readable media as recited in claim 1, wherein:

each of the track objects supports a track data interface that accepts an argument comprising one of the control type identifiers;

in response to being called with said particular control type identifier, the track data interface returns said musical performance data.

3. One or more computer-readable media as recited in claim 1, wherein:

each of the track objects supports a track data interface that accepts an argument comprising one of the control type identifiers;

in response to being called with said particular control type identifier, the track data interface returns said musical performance data along with a value indicating how long said returned controlling musical performance data will be valid.

4. One or more computer-readable media as recited in claim 1, wherein each of the track objects supports a TypeSupported interface that is called by the segment object to determine whether the track object contains the type of controlling musical performance data indicated by said particular control type identifier.

5. One or more computer-readable media as recited in claim 1, wherein:

each of the track objects supports a TypeSupported interface that is called by the segment object to determine whether the track object contains the type of controlling musical performance data indicated by said particular control type identifier;

each of the track objects supports a track data interface that is called by the segment object to return said musical performance data.

6. One or more computer-readable media as recited in claim 1, wherein the segment data interface accepts an additional argument comprising a time, and wherein the returned controlling musical performance data corresponds to said time.

7. One or more computer-readable media as recited in claim 1, wherein in response to being called with said particular control type identifier, the segment object additionally returns a value indicating how long said returned controlling musical performance data will be valid.

8. One or more computer-readable media as recited in claim 1, wherein:

the segment data interface accepts an additional argument comprising a time;

the returned controlling musical performance data corresponds to said time;

in response to being called with the particular control type identifier, the segment object additionally returns a value indicating how long said returned controlling musical performance data will be valid.

9. One or more computer-readable media as recited in claim 1, wherein the controlling musical performance data is returned in a data structure that is predefined to correspond with said particular control type identifier.

10. One or more computer-readable media as recited in claim 1, wherein:

each of the track objects supports a TypeSupported interface that is called by the segment object to determine whether the track object contains the type of controlling musical performance data indicated by said particular control type identifier;

each of the track objects supports a track data interface that accepts an argument comprising one of the control type identifiers;

the segment object calls the track data interface with said particular control type identifier to obtain said controlling musical performance data;

in response to being called with said one of the control type identifiers, the track data interface returns said musical performance data along with a value indicating how long said returned controlling musical performance data will be valid;

wherein in response to being called with said particular control type identifier, the segment object additionally returns the value indicating how long said returned controlling musical performance data will be valid.

11. One or more computer-readable media containing a computer program that is defined at least in part by program objects, the objects comprising:

a plurality of track objects, each track object containing a time sequence of musical performance data, wherein some of the track objects are dependent track objects and some of the track objects are controlling track objects, and wherein the dependent track objects contain dependent musical performance data that is interpreted based on controlling musical performance data contained in one or more of the controlling track objects;

wherein each of the controlling track objects contains a predefined type of controlling musical performance data, and wherein a plurality of different control type identifiers correspond respectively to different predefined types of controlling musical performance data;

wherein each track object supports a track data interface that accepts an argument comprising one of the control type identifiers;

wherein each of the track objects supports a TypeSupported interface that is callable to determine whether the track object contains the type of controlling musical performance data indicated by a particular one of the control type identifiers;

wherein in response to being called with said particular one of the control type identifiers, the track data interface of a particular track object returns musical performance data from the particular track object.

12. One or more computer-readable media as recited in claim 11, wherein in response to being called with said particular control type identifier, the track data interface additionally return a value indicating how long said returned musical performance data will be valid.

13. One or more computer-readable media as recited in claim 11, wherein the track data interface accepts an additional argument comprising a time, and wherein the returned controlling musical performance data corresponds to said time.

14. One or more computer-readable media as recited in claim 11, wherein the controlling musical performance data is returned in a data structure that is predefined to correspond with said particular control type identifier.

15. A method of generating music, comprising:

identifying a plurality of music segments, each music segment comprising a plurality of music tracks, each music track being defined by a time sequence of musical performance data, wherein some of the music tracks are dependent music tracks and some of the tracks are controlling music tracks, and wherein the dependent music tracks contain dependent musical performance data that is interpreted based on controlling musical performance data contained in one or more of the controlling music tracks;

wherein each of the controlling music tracks contains a predefined type of controlling musical performance data, and wherein a plurality of different control type identifiers correspond respectively to different predefined types of controlling musical performance data;

calling a segment manager with an argument comprising one of the control type identifiers;

in response to calling the segment manager, calling one or more music segments from the segment manager with an argument comprising said one of the control type identifiers to (a) identify a music track that contains the predefined type of controlling musical performance data corresponding to said one of the control type identifiers; (b) obtain controlling musical performance data from the identified music track; and (c) return the obtained controlling musical performance data.

16. A method as recited in claim 15, wherein the step of calling the segment manager includes specifying an additional argument comprising a time, and wherein the returned controlling musical performance data corresponds to said time.

17. A method as recited in claim 15, wherein:

the step of calling the segment manager includes specifying an additional argument comprising a time;

the returned controlling musical performance data corresponds to said time; and the segment manager additionally returns a value indicating how long said returned controlling musical performance data will be valid.

18. A method as recited in claim 15, wherein the controlling musical performance data is returned to the calling music track in a data structure that is predefined to correspond with said one of the control type identifiers.

19. A method as recited in claim 15, wherein:

a plurality of music segments are potentially active at any given time, the active music segments having relative priorities;

the step of calling one or more music segments from the segment manager comprises calling the music segments in order of decreasing priority until identifying a music track that contains the predefined type of controlling musical performance data corresponding to said one of the control type identifiers.

20. A method as recited in claim 15, wherein:

a plurality of music segments are potentially active at any given time, the active music segments comprising a single primary music segment and one or more optional controlling music segments;

the active music segments have relative priorities;

any active controlling music segments have higher priorities than the active primary music segment;

the step of calling one or more music segments from the segment manager comprises calling the music segments in order of decreasing priority until identifying a music track that contains the predefined type of controlling musical performance data corresponding to said one of the control type identifiers.

21. A method as recited in claim 15, wherein in response to being called from the segment manager, a music segment calls one or more of its music tracks with an argument comprising said one of the control type identifiers to (a) identify a music track in the segment that contains the predefined type of controlling musical performance data corresponding to said one of the control type identifiers; (b) obtain controlling musical performance data from the identified music track; and (c) return said obtained controlling musical performance data to the calling segment manager.

22. A method as recited in claim 15, wherein:

in response to being called from the segment manager, a music segment calls one or more of its tracks with an argument comprising said one of the control type identifiers to (a) identify a music track in the music segment that contains the predefined type of controlling musical performance data corresponding to said one of the control type identifiers; (b) obtain controlling musical performance data from the identified music track; and (c) return said obtained controlling musical performance data to the calling segment manager;

in response to being called from its music segment, a music track determines whether it contains the predefined type of controlling musical performance data corresponding to said one of the control type identifiers and, if so, returns controlling musical performance data to the calling music segment.

23. A method as recited in claim 15, wherein:

each music track is specified as belonging to one or more track groups;

the step of calling one or more music segments comprises identifying a music track that belongs to the same track group as the calling music track.

24. A method as recited in claim 15, wherein:

each of the controlling music tracks is specified as belonging to one or more track groups;

the step of calling the segment manager includes specifying an additional argument indicating one or more of the track groups;

the step of calling one or more music segments comprises identifying a music track that belongs said one or more track groups indicated by the additional argument.

25. A music generation system comprising:

a segment manager;

a plurality of segment objects;

each segment object comprising one or more track objects, each track object containing a time sequence of musical performance data, wherein some of the track objects are dependent track objects and some of the track objects are controlling track objects, and wherein the dependent track objects contain dependent musical performance data that is interpreted based on controlling musical performance data contained in one or more of the controlling track objects;

wherein each of the controlling track objects contains a predefined type of controlling musical performance data, and wherein a plurality of different control type identifiers correspond respectively to different predefined types of controlling musical performance data;

wherein a dependent track object calls the segment manager with an argument comprising a particular one of the control type identifiers to obtain controlling musical performance data;

wherein in response to being called with said particular control type identifier, the segment manager calls one or more segment objects with an argument comprising said particular control type identifier to obtain the controlling musical performance data and then returns the obtained controlling musical performance data to the calling dependent track object;

wherein in response to being called by the segment manager with said particular control type identifier, a particular segment object identifies a track object of said particular segment object that contains the type of controlling musical performance data indicated by said particular control type identifier and returns musical performance data from the identified track object to the segment manager.

26. A music generation system as recited in claim 25, wherein the called segment object additionally returns a value indicating how long said returned musical performance data will be valid.

27. A music generation system as recited in claim 25, wherein the called track object additionally returns a value indicating how long said returned musical performance data will be valid.

28. A music generation system as recited in claim 25, wherein each of the track objects supports a TypeSupported interface that is called by the segment object to determine whether the track object contains the type of controlling musical performance data indicated by said particular control type identifier.

* * * * *

UNITED STATES PATENT AND TRADEMARK OFFICE

CERTIFICATE OF CORRECTION

PATENT NO. : 6,541,689 B1
DATED : April 1, 2003
INVENTOR(S) : Fay et al.

It is certified that error appears in the above-identified patent and that said Letters Patent is hereby corrected as shown below:

Column 5,
Line 33, replace "thc" with -- the --.

Signed and Sealed this

Seventeenth Day of June, 2003

JAMES E. ROGAN
*Director of the United States Patent and Trademark Office*